US008074619B2

(12) United States Patent
Harju

(10) Patent No.: US 8,074,619 B2
(45) Date of Patent: Dec. 13, 2011

(54) ENGINE ARRANGEMENT

(75) Inventor: Bert Harju, Harads (SE)

(73) Assignee: Harju Linearwandler AB, Sjobo (SE)

( * ) Notice: Subject to any disclaimer, the term of this patent is extended or adjusted under 35 U.S.C. 154(b) by 663 days.

(21) Appl. No.: 12/067,543

(22) PCT Filed: Sep. 20, 2006

(86) PCT No.: PCT/SE2006/001071
§ 371 (c)(1),
(2), (4) Date: Aug. 8, 2008

(87) PCT Pub. No.: WO2007/035159
PCT Pub. Date: Mar. 29, 2007

(65) Prior Publication Data

US 2008/0314355 A1 Dec. 25, 2008

(30) Foreign Application Priority Data

Sep. 21, 2005 (SE) ..... 050294

(51) Int. Cl.
*F02B 75/32* (2006.01)

(52) U.S. Cl. ..... 123/197.1; 123/197.5; 123/55.2; 60/620; 74/29

(58) Field of Classification Search ..... 123/52.1, 123/54.1, 55.2–55.7, 197.1, 197.5, 41 R; 74/29, 30, 34, 46; 60/620
See application file for complete search history.

(56) References Cited

U.S. PATENT DOCUMENTS 2,482,136 A * 9/1949 Wright ..... 123/197.5
3,868,932 A * 3/1975 Toth ..... 123/197.1
3,924,576 A * 12/1975 Siewert ..... 60/620
4,159,700 A * 7/1979 McCrum ..... 60/620
4,907,548 A * 3/1990 Lee ..... 123/197.5
5,673,665 A 10/1997 Kim
6,904,888 B1 * 6/2005 Heifets ..... 123/197.1

FOREIGN PATENT DOCUMENTS

DE 2947280 5/1981
DE 3331404 A * 3/1985
DE 3531862 3/1987
GB 1489092 10/1977

OTHER PUBLICATIONS

International Search Report dated Nov. 21, 2006.
International Preliminary Report on Patentability dated Aug. 13, 2007.

* cited by examiner

*Primary Examiner* — Noah Kamen
(74) *Attorney, Agent, or Firm* — Ladas & Parry LLP

(57) ABSTRACT

An engine arrangement comprising a first assembly including a first piston in a first cylinder interconnected with a second assembly including a second piston in a second cylinder. Each of the first and second assemblies include an inlet valve for supplying a fuel mixture, and an outlet valve for removing exhaust gases. The first and second assemblies being adapted for cooperation with a gear unit to convert a translation movement into a rotary movement. The engine arrangement so includes two additional assemblies including a third piston in a third cylinder interconnected with a fourth piston in a fourth cylinder and associated valves. The two additional assemblies being adapted for cooperation with the gear unit to convert a translation movement into a rotary movement. An outlet valve of the first cylinder is connectable to an inlet valve of a third cylinder, and an outlet valve of the second cylinder is connectable to an inlet valve of the fourth cylinder, and the outlet valves of the third and the fourth cylinders are intended for removing exhaust gases.

8 Claims, 3 Drawing Sheets

ENGINE ARRANGEMENT

This application is a national stage filing under 35 U.S.C. §371 of International Application No. PCT/SE2006/001071 filed on Sep. 20, 2006, which claims the benefit of priority of Swedish Patent Application No. 0502094-6, filed on Sep. 21, 2005. The contents of each application are incorporated herein by reference.

TECHNICAL FIELD OF THE INVENTION

The present invention relates in general to an engine arrangement and more specifically to an engine arrangement with, for example, two piston and cylinder assemblies, where a first piston in a first cylinder, included in a first piston and cylinder assembly or arrangement, is interconnected with a second piston in a second cylinder, included in a second piston and cylinder assembly or arrangement, and where said piston and cylinder assemblies display an inlet valve.

Said two piston and cylinder assemblies are adapted for cooperation with a gear unit to convert a translation movement into a rotary movement.

More particularly, the present invention has for its object to propose an air-fuel driven engine arrangement, alternatively an exhaust gas driven engine arrangement and/or an interconnection of said two categories of engine arrangements to a set adapted to the engine arrangement.

BACKGROUND OF THE INVENTION

The state of the art encompasses an engine arrangement based on the "Otto"-engine technology which operates with a crankshaft device as the transmission means between a piston movement in a cylinder and an output engine shaft or crankshaft.

To this end, use is made of a stub shaft in the piston and a bearing about the crankshaft for each piston.

This transmission technology has been employed since the first engine was designed in the United States roughly a century ago.

This implies that there are normally required (applying to 4 stroke engines) at least two cylinders to produce a single engine revolution on an output shaft or crankshaft, which naturally implies that these cylinders are supplied with an air-fuel mixture once per engine revolution, hence two air-fuel inputs per engine revolution.

In addition, this function is such that only one cylinder at a time operates approx. one ½ of a revolution, the others being drawn thereby to their different operative functions, and so on.

The generator, the water pump, any hydraulic pump etc. requisite for operation take their power from these two cylinders, which are active during engine work.

In order for this to operate satisfactorily, it is necessary that the engine works at a high idling speed of approx. 1,000 RPM (revolutions per minute), at maximum speed for diesel engines of 2,500-3,500 RPM and for petrol (gasoline) driven engines a speed of 5,000-7,000 RPM.

The "Otto"-engine technology as well as the diesel technology imply that the generated engine power has low torque at low engine speeds, for which reason these normally work at high speeds of revolution in order for the torque to be higher. As a result of the "Otto"-engine technology and diesel operation, these engines cannot utilise the supplied fuel at high engine speeds, and so fuel consumption increases but does not generate power to the same extent.

A part of the prior art is an air-fuel driven engine arrangement comprising, for example, one piston and cylinder assembly where a piston is reciprocally disposed in a cylinder, valves related to the cylinder tops, one or more inlet valves and one or more outlet- or exhaust valves, and a device igniting the air-fuel mixture compressed by the movement of the piston in the cylinder.

Also previously known in the art are exhaust gas-driven engine arrangements, comprising, for example, one piston and cylinder assembly where a piston is reciprocally disposed in a cylinder, valves related to the cylinder top, one or more inlet valves and one or more outlet valves.

The prior art is also disclosed in the Patent Publication BE-A-903 173 and in Abstract WPI/DERVENT.

BRIEF SUMMARY OF THE PRESENT INVENTION

Technical Problem

Taking into account the circumstance that the technical considerations which a person skilled in the art must carry out in order to be able to offer a solution to one or more posited technical problems is, on the one hand, initially a necessary insight into the measures and/or the sequence of measures which are to be adopted, and, on the other hand, a necessary choice of the means required, in view hereof the subsequent technical problems are likely to be relevant in the evolution of the subject matter of the present invention.

Taking into consideration the state of the art, as described above in respect of an engine arrangement comprising, for example, two piston and cylinder assemblies, where a first piston in a first cylinder, included in a first piston and cylinder assembly, is interconnected with a second piston in a second cylinder, included in a second piston and cylinder assembly, and where said piston and cylinder assembly displays an inlet valve and an outlet valve, and where said two piston and cylinder assemblies are adapted for cooperation with a gear unit, converting a translation movement into a rotary movement, it is likely to be seen as a technical problem to be able to realise the importance of, the advantages associated with and/or the technical measures and considerations which will be required in order for:

- each cylinder-allocated piston within two piston and cylinder assemblies be able to drive an engine shaft half of a revolution and permit it to work in tandem, which gives 1/1 engine revolution;
- each piston allocated to a cylinder pair may operate independently of the remaining cylinder pairs included and their associated pistons, which entails that each piston/cylinder pair may be governed independently for the requisite driving force;
- two cylinders with associated pistons may operate in parallel in a 4-cylinder engine or an engine with a plurality of cylinders;
- one piston/cylinder pair which is shut off will not overload the engine shaft;
- the torque which is obtained may be high immediately from the start of the movement and will be able to increase somewhat with increasing engine speed;
- a low speed, such as less than 300-600 RPM may be selected at maximum revolutions;
- a high torque may entail a utilisation of simple gearing possibilities when necessary;
- a selected engine speed may be better adapted to the speed of a driving wheel and thereby achieve lower fuel consumption as well as employing a smaller gearbox;

the design and construction may entail a reduction in the total service weight of the engine; and/or petrol (gasoline), diesel and different gases may be selected as fuel.

There resides a technical problem in being able to realise the importance of, the advantages associated with and/or the constructive measures which will be required in order to cause an air-fuel mixture driven engine arrangement comprising in any event one piston and cylinder assembly, where one piston is reciprocally disposed in a cylinder, valves related to the cylinder top, one or more inlet valves and one or more outlet or exhaust valves, and a device igniting an air-fuel mixture compressed by the movement of the piston in the cylinder, two further include two piston and cylinder arrangements which are mutually adapted for a synchronous movement in that a first piston, in a first piston and cylinder assembly, is in direct or indirect cooperation with a second piston in a second piston and cylinder assembly.

There resides a technical problem in being able to realise the importance of, the advantages associated with and/or the constructive measures which are required in order for inlet and exhaust valves related to cylinder tops to be allocated to both a first cylinder, in a first piston and cylinder assembly, and a second cylinder, in a second piston and cylinder assembly, and with said valves controlled so that one working stroke or working step in said first piston and cylinder assembly creates an exhaust stroke or exhaust step in said second piston and cylinder assembly, and that one working stroke in said second piston and cylinder assembly creates an exhaust stroke in said first piston and cylinder assembly.

There resides a technical problem in being able to realise the importance of, the advantages associated with and/or the constructive measures which will be required in order for said first and second pistons to be fixedly united to one another by the intermediary of a gear rack, and which are in direct cooperation with one another with a geared shaft.

There resides a technical problem in being able to realise the importance of, the advantages associated with and/or the constructive measures which will be required in order for said first piston to be fixedly united with a first gear rack, that said second piston may be fixedly united with a second gear rack, where both gear racks are in cooperation with a geared shaft.

There resides a technical problem in being able to realise the importance of, the advantages associated with and/or the constructive measures which will be required in order for said first gear rack to be given an angle, in relation to said second gear rack, which is less than a right angle.

There resides a technical problem in being able to realise the importance of, the advantages associated with and/or the constructive measures which will be required in order for an exhaust gas driven engine arrangement, comprising in any event one piston and cylinder assembly, where one piston is reciprocally disposed in a cylinder, valves related to cylinder top, one or more inlet valves and one or more outlet valves to be formed by two piston and cylinder assemblies which are mutually adapted for a synchronous movement in that a first piston, in a first (third) piston and cylinder assembly is in direct or indirect cooperation with a second (fourth) piston, in a second (fourth) piston and cylinder assembly, where inlet- and outlet valves related to cylinder tops are allocated to both a first (third) cylinder, in a first (third) piston and cylinder assembly, and a second (fourth) cylinder in a second (fourth) piston and cylinder assembly.

There resides a technical problem in being able to realise the importance of, the advantages associated with and/or the constructive measures which will be required in order for said valves to be governed so that one working stroke, in said first (third) piston and cylinder assembly, by the supply of exhaust gases under pressure, creates an exhaust stroke or step in second (fourth) piston and cylinder assembly, and that one working stroke in said second (fourth) piston and cylinder assembly, by the admission of exhaust gases under pressure, creates an exhaust stroke or step in said first (third) piston and cylinder assembly.

There resides a technical problem in being able to realise the importance of, the advantages associated with and/or the constructive measures which are required in order for said first (third) and second (fourth) pistons to be fixedly united with one another and be in direct cooperation with one another by the intermediary of a gear rack which is in cooperation with a geared shaft.

There resides a technical problem in being able to realise the importance of, the advantages associated with and/or the constructive measures which will be required in order for said first (third) piston to be fixedly united with a first (third) piston, for said second (fourth) piston to be fixedly united with a second (fourth) gear rack, where both gear racks are in cooperation with a geared shaft.

There resides a technical problem in being able to realise the importance of, the advantages associated with and/or the constructive measures which will be required in order for said first (third) gear rack to be given an angle in relation to said second gear rack which is less than a right angle.

There resides a technical problem in being able to realise the importance of, the advantages associated with and/or the constructive measures which will be required in order for one or more air-fuel powered engine arrangements to be coordinated to one and the same shaft and for one or more of these air-fuel powered engine arrangements to be able to be coordinated with one or more exhaust gas powered engine arrangements which are also coordinated to said one and the same shaft.

There resides a technical problem in being able to realise the importance of, the advantages associated with and/or the technical measures and considerations which will be required in order for in any event two additional piston and cylinder assemblies with a third piston in a third cylinder included in a third piston and cylinder assembly interconnected with a fourth piston in a fourth cylinder included in a fourth piston and cylinder assembly with associated inlet and outlet valves to be adapted for a cooperation with a gear unit converting said translation movement into a rotary movement, wherein an outlet valve for a first cylinder is to be interconnected with an inlet valve for a third cylinder, and an outlet valve for a second cylinder is to be interconnected with an inlet valve for a fourth cylinder, and the outlet valves for said third and said fourth cylinders are to be intended to remove combusted exhaust gases.

There resides a technical problem in being able to realise the importance of, the advantages associated with and/or the technical measures and considerations which will be required in order, when a first cylinder is fuel activated, to cause the displacement of the first piston to a lower position (close to the shaft of the gear unit) while the second piston in a second cylinder is displaced to its upper position (distal from the driven or live shaft of the gear unit).

There resides a technical problem in being able to realise the importance of, the advantages associated with and/or the technical measures and considerations which will be required in order, during these piston movements, to create the preconditions for two discrete and separate events or functions.

There resides a technical problem in being able to realise the importance of, the advantages associated with and/or the technical measures and considerations which will be required in order for the exhaust gases obtained in an immediately preceding working cycle to be compressed at the same time as the first piston in the first cylinder is retarded in its movement.

There resides a technical problem in being able to realise the importance of, the advantages associated with and/or the technical measures and considerations which will be required in order to cause this movement speed to be regulated by the opening/closing time of an exhaust valve.

There resides a technical problem in being able to realise the importance of, the advantages associated with and/or the technical measures and considerations which will be required in order, when an exhaust valve opens, to cause the exhaust gas pressure to be led to a fourth cylinder and its inlet valve, which entails that the fourth piston in the fourth cylinder is activated and an additional working input is obtained, without external fuel supply for this movement.

There resides a technical problem in being able to realise the importance of, the advantages associated with and/or the technical measures and considerations which will be required in order to cause one and the same sequence to be repeated in a fourth cylinder and in a third cylinder, respectively, while exhaust gases depart via exhaust valves in the third and fourth cylinders, for example to a silencer.

There resides a technical problem in being able to realise the importance of, the advantages associated with and/or the technical measures and considerations which will be required in order that, if the piston and cylinder assemblies coordinated in a pair operate (or idle) at a lower speed than the rotation of the gear unit not actively to influence the rotation of the output shaft of the gear unit.

There resides a technical problem in being able to realise the importance of, the advantages associated with and/or the technical measures and considerations which will be required in order, when a supply of additional energy is selected to be slight, such as when the supply of additional energy is throttled in a downhill slope, to cause a vehicle to roll without inactive piston and cylinder assemblies braking the gear unit and in an increased supply of additional energy, such as on acceleration, the activated piston and cylinder assembly overhauls the output shaft of the gear unit and thereafter participates in a continued work.

Solution

The present invention takes as its point of departure the prior art as disclosed by way of introduction, where an air-fuel powered engine arrangement comprising: for example one piston and cylinder assembly, where a piston is reciprocally disposed in a cylinder; valves related to the cylinder top, one or more inlet valves and one or more outlet or exhaust valves, and a device igniting an air and fuel mixture compressed by the movement of the piston in the cylinder.

In order to be able to solve one or more of the above-outlined technical problems, the present invention discloses that two piston and cylinder assemblies are to be mutually adapted for a synchronous movement in that a first piston, in a first piston and cylinder assembly, is in direct or indirect cooperation with a second piston, in a second piston and cylinder assembly, that inlet and exhaust valves related to cylinder tops are allocated to both a first cylinder in a first piston and cylinder assembly and a second cylinder in a second piston and cylinder assembly, and with said valves controlled so that one working stroke in said first piston and cylinder assembly creates an exhaust stroke in said second piston and cylinder assembly, and that a work stroke in said second piston and cylinder assembly creates an exhaust stroke in said first piston and cylinder assembly.

In one embodiment, first and second pistons are fixedly united with one another by the intermediary of a gear rack which are in direct cooperation with one another with a geared shaft.

It is further disclosed that said first piston is fixedly united with a first gear rack, that said second piston is fixedly united with a second gear rack where both gear racks are in cooperation with a geared shaft.

It is further proposed that said first gear rack be given an angle in relation to said second gear rack which is less than a right angle.

The present invention also discloses an exhaust gas driven engine arrangement comprising: for example one piston and cylinder assembly, where a piston is reciprocally disposed in a cylinder, valves related to cylinder top, one or more inlet valves and one or more outlet valves.

In order to be able to solve one or more of the above-disclosed technical problems, the present invention discloses that two piston and cylinder assemblies are mutually adapted for a synchronous movement in that a first piston, in a first (third) piston and cylinder assembly is in direct or indirect cooperation with a second (fourth) piston in a second (fourth) piston and cylinder assembly, that inlet and outlet valves related to cylinder tops are allocated to both a first (third) cylinder in a first (third) piston and cylinder assembly and a second (fourth) cylinder in a second (fourth) piston and cylinder assembly and with said valves controlled so that one working stroke in said first (third) piston and cylinder assembly, as a result of the supply of exhaust gases under pressure, creates an exhaust stroke in said second (fourth) piston and cylinder assembly and that a working stroke in said second (fourth) piston and cylinder assembly, as a result of the supply of exhaust gases under pressure, creates an exhaust stroke in said first (third) piston and cylinder assembly.

In one embodiment, the first (third) and second (fourth) pistons are fixedly united to one another and are in direct cooperation with one another by the intermediary of a gear rack which is in cooperation with a geared shaft.

It is further disclosed that said first (third) piston is fixedly united with a first (third) piston rod, that said second (fourth) piston is fixedly united with a second (fourth) gear rack, where both gear racks are in cooperation with a geared shaft.

Moreover, it is disclosed that said first (third) gear rack may be given an angle in relation to said second gear rack which is less than a right angle.

The present invention furthermore provides a set related to an engine arrangement where one or more air-fuel driven engine arrangements are coordinated to one and the same shaft and that one or more of these air-fuel driven engine arrangements are coordinated with one or more exhaust gas driven engine arrangements which are similarly coordinated to said one and the same shaft.

The present invention moreover takes as its point of departure the prior art as disclosed by way of introduction, where an engine arrangement is disclosed with in any event two piston and cylinder assemblies, where a first piston in a first cylinder, included in a first piston and cylinder assembly, is interconnected with a second piston in a second cylinder, included in a second piston and cylinder assembly, and where each one of said piston and cylinder assemblies include an inlet valve for the supply of a fuel mixture, and an outlet valve for the removal of exhaust gases, said two piston and cylinder assemblies being adapted for a cooperation with a gear unit converting a translation movement into a rotary movement.

In order to be able to resolve one or more of the above-disclosed technical problems, the present invention particularly discloses that the prior art technology be complemented by providing two further piston and cylinder assemblies, one with a third piston in a third cylinder, included in a third piston and cylinder assembly, interconnected with a fourth piston in a fourth cylinder, included in a fourth piston and cylinder assembly, with associated inlet and outlet valves, to be adapted for cooperation with said gear unit converting translation movement into rotary movement, an outlet valve for a first cylinder being interconnected with an inlet valve for a third cylinder, and an outlet valve for a second cylinder being interconnected with an inlet valve for a fourth cylinder, and that outlet valves associated with the third and fourth cylinders are to be intended to remove combusted exhaust gases.

In one embodiment, a first cylinder within said first piston and cylinder assembly is fuel activated, the first piston is displaced to a lower position while the second piston in the second cylinder is displaced to its upper position.

During this movement, two events take place: the exhaust gases obtained in an earlier cycle are compressed, at the same time as the first piston in the first cylinder is retarded in its movement.

This movement speed is regulated by the opening/closing time of the exhaust gas valve.

When the exhaust gas valve within said first piston and cylinder assembly opens, the exhaust gas pressure is led to the fourth cylinder and its inlet valve, which entails that the fourth piston in the fourth cylinder is activated and an additional working input is obtained without the external additional supply of energy for this movement.

It is further disclosed that the same sequence is repeated in a fourth cylinder and in a third cylinder, respectively, while exhaust gases from the exhaust gas valves in the third and fourth cylinders depart, for example to a silencer.

If a pair of coordinated piston and cylinder assemblies works (or idles) at a lower speed than that which applies to the rotation of the gear unit, the rotation of the output shaft is not affected.

It is further disclosed that when additional energy is selected to be slight, such as when the additional energy is throttled in a downhill situation for a vehicle, the vehicle will roll without inactive piston and cylinder assemblies braking the movement of the gear unit and, in an increased additional supply of energy, as is the case in acceleration, the piston and cylinder assembly overhauls the rotary shaft of the gear unit and thereafter participates in continued work.

Advantages

The present invention provides an air-fuel driven and/or an exhaust gas driven engine arrangement with, for example, two piston and cylinder assemblies, where a first piston in a first cylinder, included in a first piston and cylinder assembly, is interconnected with a second piston in a second cylinder, included in a second piston and cylinder assembly, and where each one of said piston and cylinder assemblies displays an inlet and an outlet valve, said two piston and cylinder assemblies being adapted for cooperation with a gear unit converting a translation movement into a rotary movement.

In such instance, the utilisation is made available of two additional piston and cylinder assemblies, with a third piston in a third cylinder, included in a third piston and cylinder assembly, interconnected with a fourth piston in a fourth cylinder, included in a fourth piston and cylinder assembly with associated inlet and outlet valves, said two additional piston and cylinder assemblies being adapted for cooperation with said gear unit converting a translation movement into a rotary movement.

An outlet valve for the first cylinder may be interconnected with an inlet valve for the third cylinder, while an outlet valve for the second cylinder may be interconnected with the inlet valve for the fourth cylinder. The outlet valves for the third and the fourth cylinders may be intended for the removal of combusted exhaust gases.

BRIEF DESCRIPTION OF THE ACCOMPANYING DRAWINGS

One currently proposed embodiment, displaying the significative characterising features associated with the present invention will now be described in greater detail hereinbelow for purposes of exemplification, with reference to the accompanying Drawings, where:

DESCRIPTION OF CURRENTLY PROPOSED EMBODIMENT

Figure 1:
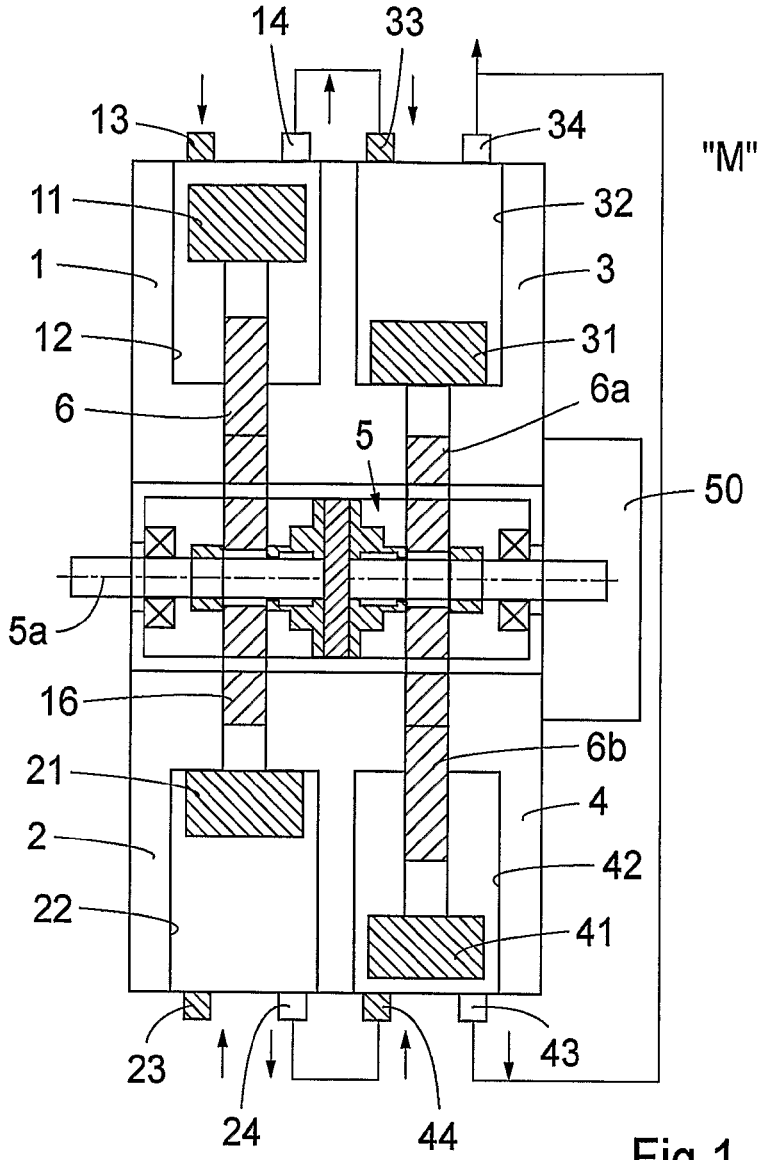
FIG. 1 shows an engine arrangement with two pairwise active piston and cylinder assemblies, where a first pair of piston and cylinder assemblies consists of an air-fuel driven engine arrangement, while a second pair of piston and cylinder assemblies consists of an exhaust gas driven engine arrangement.

By way of introduction, it should be emphasized that, in the following description of one currently proposed embodiment which displays the significative characterising features associated with the present invention and which is clarified by means of the drawing figures shown in the accompanying Drawings, we have selected terms and a specific terminology with a view in such instance principally to clarifying the inventive concept as herein disclosed.

In this context, it should nevertheless be observed that the expressions selected here should not be seen as restrictive exclusively to the terms selected and utilised herein, but that it should be understood that every such selected term is to be interpreted so that, in addition, it encompasses all technical equivalents which function in the same or substantially the same manner in order, in such instance, to be able to attain the same or substantially the same intention and/or technical effect.

With reference to accompanying FIGS. 1 to 5, there are thus illustrated schematically and in detail the basic preconditions for the present invention and where the significative properties associated with the present invention have been given concrete form as a result of the currently proposed embodiment described in greater detail hereinbelow.

FIG. 1 illustrates, partly in section, an engine arrangement 1 driven by an air-fuel mixture, where a first piston 11 is reciprocally disposed in a first cylinder 12, valves 13, 14 related to cylinder tops, one or more inlet valves and one or more outlet- or exhaust valves, and a device (not shown) igniting the air-fuel mixture compressed by the movement of the piston 11 in the cylinder 12.

Two piston and cylinder assemblies 1, 2 are mutually adapted for a synchronous movement in that a first piston 11, in a first piston and cylinder assembly 1, is in direct or indirect cooperation with a second piston 21, in a second piston and cylinder assembly 2, with inlet valves 13, 23 and exhaust gas valves 14, 24 related to cylinder tops, allocated to both a first cylinder 11 in a first piston and cylinder assembly 1 and a second cylinder 22 in a second piston and cylinder assembly 2.

Said valves are governed so that one working stroke, in said first piston and cylinder assembly 1, creates an exhaust stroke in said second piston and cylinder assembly 2, and that a working stroke in said second piston and cylinder assembly 2 creates an exhaust stroke in said first piston and cylinder assembly 1.

It is more particularly disclosed in FIG. 1 that said first 11 and second pistons 21 are fixedly united to one another by the intermediary of a gear rack 6, which are in direct cooperation with one another with a geared shaft 5*a*, with a flywheel 50.

Said first piston 11 may be fixedly united with a first gear rack 6, that said second piston 21 may be fixedly united with a second gear rack 16, where both gear racks 6, 16 are in cooperation with a geared shaft 5*a*.

In such instance, said first gear rack 6 may be given an angle in relation to said second gear rack 16 which is less than a right angle.

The present invention further discloses that an exhaust gas driven engine arrangement comprising: in any event one piston and cylinder assembly 3, where a piston 31 is reciprocally disposed in a cylinder 32, valves 33, 34 related to cylinder tops, one or more inlet valves 33 and one or more outlet valves 34.

Two piston and cylinder assemblies 3, 4 are mutually adapted for a synchronous movement in that a first piston 31 in a first (third) piston and cylinder assembly 3 is in direct or indirect cooperation with a second piston 41 in a second (fourth) piston and cylinder assembly 4.

Inlet and outlet valves related to cylinder tops are allocated both a first (third) cylinder 32 in a first (third) piston and cylinder assembly 3, and a second (fourth) cylinder 42 in a second (fourth) piston and cylinder assembly.

Said valves are governed so that a working stroke in said first (third) piston and cylinder assembly 3, by the supply of exhaust gases under pressure via the valve 33, creates an exhaust stroke in said second (fourth) piston and cylinder assembly 4 and that a working stroke in said second (fourth) piston and cylinder assembly 4, by the supply of exhaust gases under pressure, creates an exhaust stroke in said first (third) piston and cylinder assembly 3.

The embodiment illustrates that said first (third) 31 and second (fourth) 41 pistons are fixedly united to one another and are in direct cooperation with one another by the intermediary of a gear rack 6*a*, which is in cooperation with a geared shaft 5*a* and a flywheel 50.

Said first (third) piston 31 is fixedly united with a first (third) piston rod 6*a*, that said second (fourth) piston 41 is fixedly united with a second (fourth) gear rack 6*b*, where both of the gear racks are in cooperation with a geared shaft 5*a*.

Said first (third) gear rack 6*a* may be given an angle in relation to said second gear rack 6*b* which is less than a right angle.

The present invention moreover encompasses an engine arrangement set where one or more air-fuel driven engine arrangements 1, 2 are coordinated to one and the same shaft 5*a* and that one or more of these air-fuel driven engine arrangements 1, 2 are coordinated with one or more exhaust gas driven engine arrangements 3, 4 which similarly coordinated to said one and the same shaft 5*a*.

Thus, FIG. 1 moreover illustrates, partly in section, an engine arrangement set "M", according to the present invention, with in any event two piston and cylinder assemblies 1, 2, where a first piston 11 in a first cylinder 12 included in a first piston and cylinder assembly 1 is interconnected with a second piston 21 in a second cylinder 22 included in a second piston and cylinder assembly 2, and where each one of said piston and cylinder assemblies 1, 2 each displays a valve serving as inlet valve 13, 23 adapted for the supply of a fuel mixture, and each a valve serving as outlet valve 14, 24 adapted for the removal of combusted exhaust gases.

Said two piston and cylinder assemblies 1, 2 are adapted for cooperation with a gear unit 5 converting a translation movement oriented between the assemblies 1 and 2 into a rotary movement.

Two further piston and cylinder assemblies 3, 4 with a third piston 31 in a third cylinder 32 included in a third piston and cylinder assembly 3, interconnected with a fourth piston 41 in a fourth cylinder 42 included in a fourth piston and cylinder assembly 4, with associated valves 33, 44 and valves 34, 43, said two additional piston and cylinder assemblies 3, 4 being adapted for a corresponding cooperation with said gear unit 5 converting the translation movement into a rotary movement.

The outlet valve 14 for the first cylinder 12 is interconnected with the inlet valve 33 for the third cylinder 32.

The outlet valve 24 for the second cylinder 22 is interconnected with the inlet valve 44 for the fourth cylinder 42, and that the outlet valves 34, 43 for the third 32 and the fourth cylinders 42 are intended to remove combusted exhaust gases.

When the first cylinder 12 is fuel activated, the first piston 11 is displaced to a lower position (a position proximal a driven or live shaft 5*a* for the gear unit 5), while the second piston 21 in the second cylinder 22 is displaced to its upper position (a position distally directed from a driven or live shaft 5*a* for the gear unit 5).

Two events take place during this piston movement.

The exhaust gases obtained in earlier cycle are compressed, at the same time as the first piston 11 in the first cylinder 12 is retarded in its movement.

This movement speed is governed by the opening time/closing time of the exhaust gas valve.

When the exhaust gas valve 24 opens, the exhaust gas pressure is led to the fourth cylinder 42 and its inlet valve 44, which entails that the fourth piston 41 in the fourth cylinder 42 is activated and an additional working input is obtained without any external additional fuel supply for this movement.

The same sequence is repeated in the fourth cylinder 42 and in the third cylinder 32, respectively, while exhaust gases from the exhaust gas valves in the third 32 and fourth cylinders 42 depart to a silencer.

From this it follows that if piston and cylinder assemblies 1, 2; 3, 4 cooperating in pairs work (or idle) at a slower speed than the rotation of the gear unit, the rotation of a output shaft will not be affected.

When an additional supply of energy is selected to be small, such as when the supply of additional energy is throttled in a downhill, a vehicle will roll without the inactive piston and cylinder assemblies braking the movement of the gear unit, and in the event of increased energy supply, as in acceleration, the piston and cylinder assembly overhauls the rotary shaft of the gear unit and thereafter participates in continued work.

This form of engine unit works in accordance with a hitherto unknown operative method, which is characterised by a fuel economy function.

The working cycle may then be as follows:

The piston and cylinder assembly 1 is a prime mover or drive unit, while the assembly 2 is an exhaust gas driven unit, where a coupling between these units 1, 2 may be put into effect in accordance with the following outline:

The inlet valve 13 to the cylinder 12 is fed with a fuel mixture, while the outlet valve 14 is directly connected to the inlet valve 33 for the cylinder 32.

The inlet valve 23 to the cylinder 22 is feedable with a fuel mixture, while the outlet valve 24 is directly connected to the inlet valve 44 for the cylinder 42.

The outlet valves 34, 43 (the exhaust valves) are connected to a silencer (not shown).

The operative function will be as follows:

When the cylinder 12 is fuel-activated, the piston 11 is displaced to a lower position, while the piston 21 in cylinder 22 is moved from its lower position to the upper position.

During this movement, the following two events vital to operation take place:

The exhaust gases obtained in earlier cycles are compressed, at the same time as the piston 11 in the cylinder 12 is retarded in its movement. This movement speed is governed by the opening time/closing time of the exhaust valve 14.

When the outlet or exhaust valve 14 opens, the exhaust gas pressure (which is more or less of the same order of magnitude as the input pressure), is led to cylinder 32 and its inlet valve 33, which entails that the piston 31 in cylinder 32 is activated and an additional working input is obtained, without any external additional supply of fuel for this movement.

The same sequence is repeated in cylinder 42 and cylinder 32, respectively, and the exhaust gases from the exhaust valves 34, 43 depart to a silencer (not shown).

A fuel saving of approx. 50% may be possible with this new technology taken as a whole, compared with today's hundred-year old engine technology.

This new technology also implies that if the engine includes a plurality of arrangements 1, 2, 3, 4, any of them can be shut off from fuel supply, for example, in order possibly to drive with a light load in the vehicle. This does not affect the engine shaft at all, since this rotates more quickly.

Today's engines do the same thing, shut off the fuel, still load the remaining prime mover or drive unit, since the same crankshaft is employed for all cylinders in the engine.

A crucially important difference between today's engine technology and the engine according to the present invention is that it is possible to consider a standard engine, with two mounted pairwise piston and cylinder assemblies, as two individual engines working in parallel, but may also be capable of working singly, if one of the engine functions ceases to work, but with 50% of the engine output.

A suitable function is relating to helicopters and piston driven propeller powered aircraft where, for example, an engine failure would jeopardise vital functions in the community.

The disclosed low revolution engine with high torque is suitable as an industrial engine, stationary and mobile machinery, for example contractor machinery such as excavators and similar working inputs which often work at high speeds of revolution for lengthy periods of time.

As a result of the counter-directed working function, a balanced engine operation will be obtained (less vibration).

Figure 2:
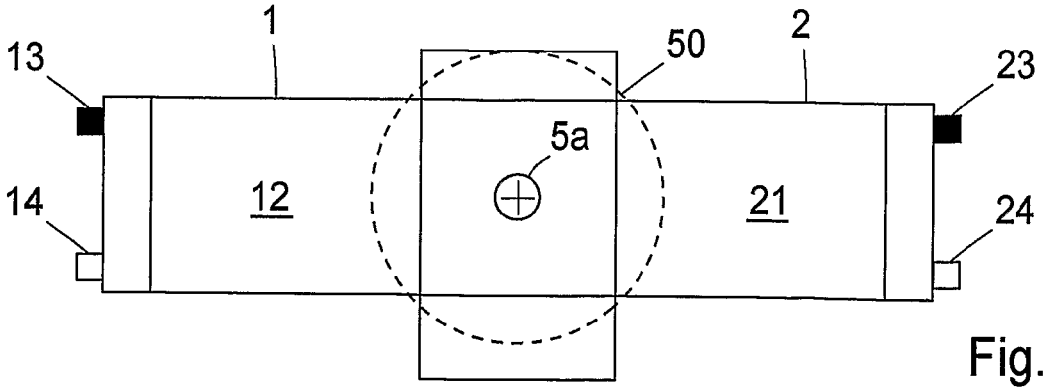
FIG. 2 is a side elevation of the engine arrangement according to FIG. 1.
Figure 3:
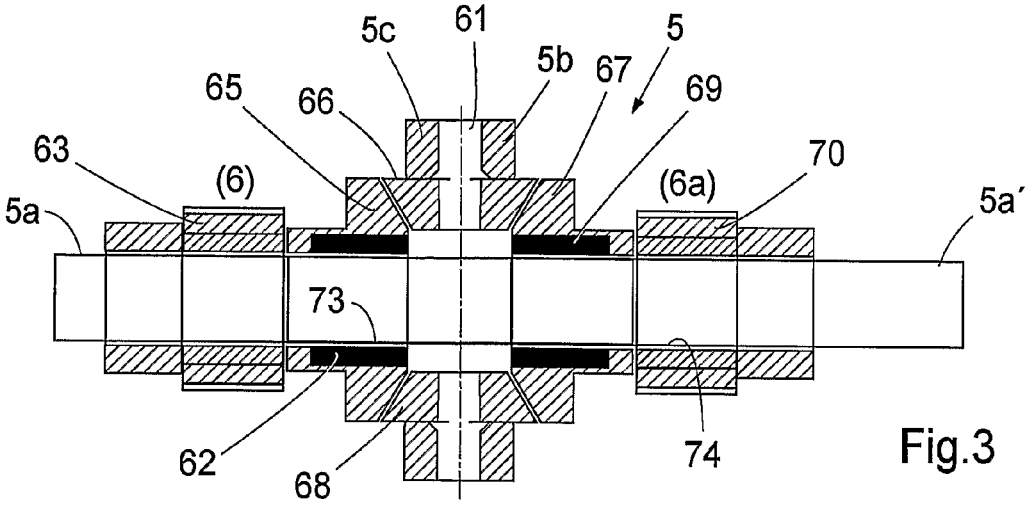
FIG. 3 shows a first embodiment of a gear unit converting a translation movement into a rotary movement.
Figure 4:
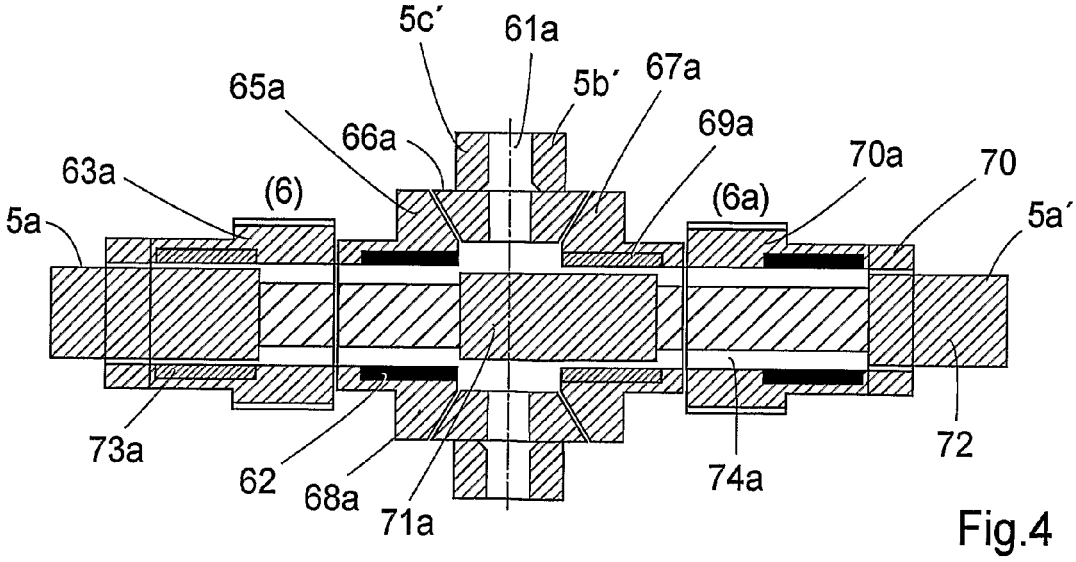
FIG. 4 shows a second embodiment of a gear unit converting a translation movement into a rotary movement.
Figure 5:
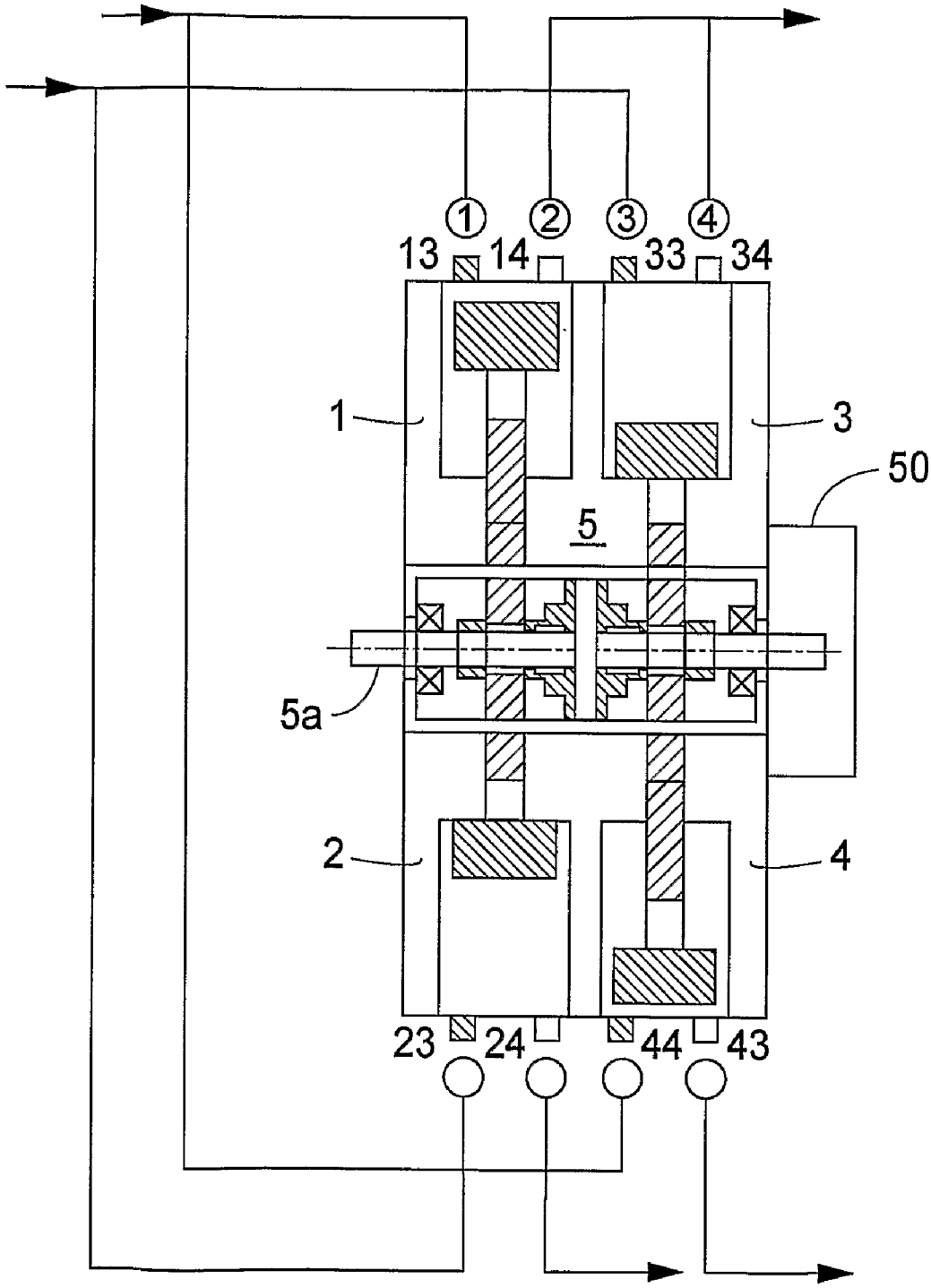
FIG. 5 shows an engine arrangement with two pairwise cooperating piston and cylinder assemblies each one of which being drivable by an air-fuel mixture.

With reference to FIGS. 3 and 4, two alternatives are shown in these figures for a gear unit 5, according to FIGS. 1 and 2.

Description of selected numbering of the gear unit 5 according to FIG. 3, and with reversing function of output engine shaft 5*a*, illustrated in FIG. 4.

Fixing screws 61, 61*a* for return gear wheel 5*c*, 5*c*' to a body.

Locking bearing 62, 62*a* integrated in left crown wheel 65, 65*a* together with a part constituting driving of the engine shaft 5*a* in a clockwise rotation, mounted in a counter-directed driving direction.

Driving gear wheel 63, 63*a* from a gear rack 6, left-hand side.

Left crown wheel 65, 65*a* and right crown wheel 67, 67*a*.

Upper 66, 66*a* and lower 68, 68*a* turning gear wheel.

Right locking bearing 69, 69*a* integrated in right crown wheel 67, 67*a* together with a part constituting driving of the engine shaft in a counter clockwise direction, mounted in the counter-directed driving direction.

Driving gear wheel 70, 70*a* from the gear rack 6*a*, right-hand side.

Engagement surface 71*a* for locking bearing.

Engagement surface 72 for locking bearing alternatively also locking bearing in reverse movement.

Engagement surface 73*a* for locking bearing alternatively also a locking bearing in reversing movement.

Engine shaft 5*a*, 5*a*'.

Space 74, 74*a* of smaller diameter where engagement cannot be effected (movement distance reversing).

Alternatively, the engine shaft 5*a*, 5*a*' may be moved laterally by mechanical, electric or hydraulic means, or a loose sleeve 71*a* may constitute this movement mounted on the engine shaft, where engagement between the shaft and the sleeve is put into effect. Both of these embodiments may be employed depending upon the suitable application mounting.

Description of Reversing Movement for a Rotation Converter According to FIG. 4

A drive engine function includes in most cases a reversing movement carried out by an engaged gearbox.

In boats and in other applications, use is made of a simpler type which is called astern stroke, for carrying out the desired reversing of the working direction.

The present invention encompasses an engine construction with a reversing movement which offers a simple design integrated direct in the engine body.

In such instance, reversing is created of the direction of rotation of the drive shaft with the engine in idling without any load connected in (clutch or other transmission function activated which disengages the engine power from the load).

Reversing may be applied for boat engines, scooter engines and also working machines where reversing of supply table and similar functions are employed.

This extension is put into effect according to the same principle as the ordinary rotation converter, with the difference that twice the number of locking bearing pairs are mounted, these in the working direction facing towards one another in order for reversing to be possible.

This change may be effected with a positional displacement of the engine shaft or alternatively a mounted sleeve for this movement, splines may constitute the coupling between the sleeve and the engine shaft.

According to the principle of the present invention, two functions are utilised which will be described in greater detail.

The first implies that two piston and cylinder pairs (boxer pairs) always work coupled together with one another in such a manner that cylinder 12 and cylinder 42 both operate with simultaneous fuel supply and also simultaneous exhaust gas voiding from the cylinders, hence cylinder 12, fuel 13, cylinder 42, fuel 44;

cylinder 12, exhaust 14, cylinder 42, exhaust 43.

Similarly, cylinder 22 and cylinder 32 obtain the same functions during the next sequence, and so on, i.e. a two stroke function with pairwise operation.

This may be a standard function implying double cylinder forces during the operating phase.

The second working function relates only to fuel supply for cylinder 12 as well as cylinder 22 (single-action boxer engine) with exhaust driving of cylinder 32 and cylinder 42.

This function operates with considerably lower fuel consumption as a result of the utilisation of the compression method, as well as the braking method for the operating cylinder. This basic function replaces the crankshaft function which moves the working piston back to its working position.

The present invention is naturally not restricted to the embodiment disclosed above by way of example, but may undergo modifications without departing from the scope of the inventive concept as disclosed in the appended Claims.

In particular, it should be observed that each illustrated unit and/or circuit may be combined with every other illustrated unit and/or circuit without departing from the scope of the invention in order to be able to attain the desired technical function.

The invention claimed is:

1. An engine comprising:

a first assembly including a first piston reciprocally disposed in a first cylinder where valves;

a second assembly including a second piston reciprocally disposed in a second cylinder, the second assembly being adapted for a synchronous movement with the first assembly such that said first piston moves in cooperation with said second piston; and third and fourth assemblies which are mutually adapted for a synchronous movement with one another, the third assembly including a third piston moving in cooperation with a fourth piston of the fourth assembly;

wherein a power stroke of said first piston effects an exhaust stroke of said second piston; and a power stroke of said second piston effects an exhaust stroke of said first piston, wherein the first, second, third, and fourth assemblies are adapted for cooperation with a gear unit to convert a translational movement into a rotary movement, wherein a first outlet valve of the first cylinder is interconnected with a third inlet valve of the third cylinder, and a second outlet valve of the second cylinder is interconnected with a fourth inlet valve of the fourth cylinder; the third and the fourth cylinders are provided with outlet valves for removing exhaust gases; and wherein the gear unit includes an engine shaft and means for reversing a rotation of the engine shaft by moving the engine shaft in a lateral direction.

2. An engine as claimed in claim 1, wherein said first piston is fixedly united with a first gear rack; and that said second piston is fixedly united with a second gear rack, where both gear racks are in cooperation with a first geared shaft.

3. An engine as claimed in claim 1, wherein, said first gear rack is given an angle, in relation to said second gear rack, which is less than a right angle.

4. An engine as claimed in claim 1, wherein the first and second pistons are arranged with respect to each other such that when the first cylinder is displaced during combustion towards a first end position, the second piston is displaced during compression towards a first position.

5. An engine as claimed in claim 1, wherein the first and second pistons are arranged with respect to each other such that exhaust gases, obtained in an earlier process cycle, within said second piston and cylinder assembly, are compressed, at the same time as the first piston, in the first cylinder, is retarded in its movement, during its working stroke.

6. An engine as claimed in claim 5, wherein an exhaust gas valve is provided to govern a speed of the movement by an opening/closing timing of the exhaust gas valve.

7. An engine as claimed in claim 6, wherein the first outlet valve of the first assembly and the third inlet valve of the third assembly are interconnected such that when the first outlet valve opens, a generated exhaust gas pressure is led to said third cylinder and said third inlet valve to activate the fourth piston in the fourth cylinder.

8. An engine as claimed in claim 1, further comprising a sleeve mounted on the engine shaft for moving the engine shaft in the lateral direction to reverse the rotation of the engine shaft.

* * * * *

UNITED STATES PATENT AND TRADEMARK OFFICE

CERTIFICATE OF CORRECTION

PATENT NO. : 8,074,619 B2
APPLICATION NO. : 12/067543
DATED : December 13, 2011
INVENTOR(S) : Harju It is certified that error appears in the above-identified patent and that said Letters Patent is hereby corrected as shown below:

Title page, item (30), Foreign Application Priority Data: "050294" should read --0502094-6--.

Signed and Sealed this
Fifteenth Day of May, 2012

David J. Kappos

David J. Kappos
*Director of the United States Patent and Trademark Office*